US005530986A

United States Patent [19]

Rackley, Sr.

[11] Patent Number: 5,530,986

[45] Date of Patent: Jul. 2, 1996

[54] BUFFER COVERING

[76] Inventor: Ronald L. Rackley, Sr., P.O. Box 15582, Tallahassee, Fla. 32317

[21] Appl. No.: 224,040

[22] Filed: Apr. 7, 1994

[51] Int. Cl.[6] ..... B65D 65/02; B65D 85/00

[52] U.S. Cl. ..... 15/247; 206/303; 150/165

[58] Field of Search ..... 15/246, 247, 230, 15/228, 147.2, 98; 206/576, 303, 304.1; 150/165, 161, 154

[56] References Cited

U.S. PATENT DOCUMENTS

| | | | |
|---|---|---|---|
| 2,088,650 | 8/1937 | Hartley | 15/98 |
| 2,304,127 | 12/1942 | Stetson | 15/247 |
| 2,432,662 | 12/1947 | Gardner | 150/154 |
| 2,490,451 | 12/1949 | Magid | 150/154 |
| 3,620,309 | 11/1971 | Erickson et al. | 150/154 |
| 3,716,885 | 2/1973 | Thompson | 15/247 |
| 4,731,894 | 3/1988 | Ashworth | 15/230 |
| 5,088,377 | 2/1992 | Delecaris | 206/303 |

FOREIGN PATENT DOCUMENTS

| | | | |
|---|---|---|---|
| 0545250 | 8/1957 | Canada | 15/230 |

*Primary Examiner*—Timothy F. Simone
*Assistant Examiner*—Reginald L. Alexander
*Attorney, Agent, or Firm*—Peter Loffler

[57] ABSTRACT

This present invention provides for a buffer cover that will fit and conform to any conventional buffer either floor or hand-held size. The buffer cover includes a shell. Located inside the shell is an absorbent layer. The buffer cover will protect floors and other surfaces from chemical drips when relocating the buffer from one work location to the next work location.

7 Claims, 1 Drawing Sheet

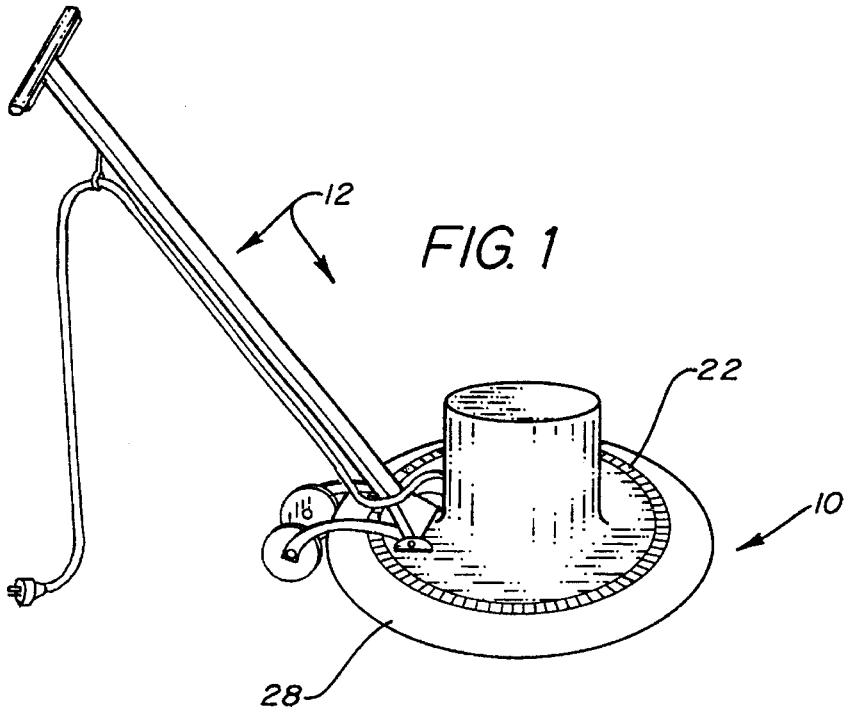
FIG. 1
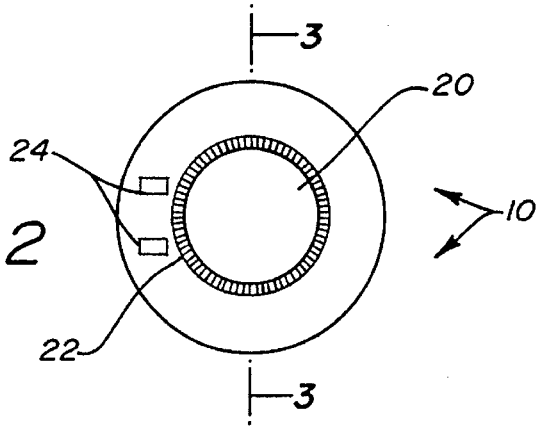
FIG. 2
FIG. 3
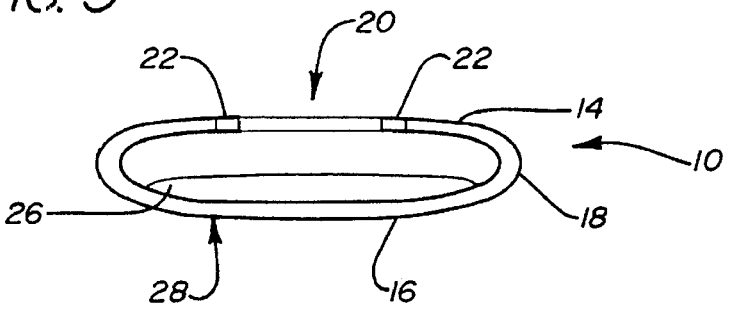

BUFFER COVERING

BACKGROUND OF THE INVENTION

Buffing machines are generally produced in two sizes. A hand-held size is used for furniture, automobiles, and the like, and a floor model is used for floors.

Various chemicals are used with such buffers including: waxes, polishes, strippers, etc. Such chemicals are used to maintain and clean some particular surface such as a floor. However, these same chemicals can have adverse effects on other surfaces such as carpeting.

Therefore, when a person finishes stripping a floor and moves on to another floor and there is carpeting between the two floors, he must take certain precautions so that the chemicals on the pad do not drip onto the carpeting. Typically, this requires the removal of the buffing pad from the buffer and moving the two across the carpet independently. Such a procedure is time-consuming and is not fool-proof.

Another problem with buffers is the necessity of cleaning the buffing pad when the pad will not be used for a long period of time such as at lunch time. During such periods, the pad must be removed and cleaned. This is necessary so that the pad does not dry out and become useless. After lunch the same chemical that was removed only about an hour earlier, is reapplied on the pad. Again, this is a time-consuming endeavor.

What is needed is a device whereby a person using harsh chemicals on a buffer, can cross a sensitive surface without fear of damaging the surface. Such a device should be able to prevent a buffing pad from drying out when the pad is not used for a period of time. The device should be of simple construction and be easy to use.

SUMMARY OF THE INVENTION

The present invention provides for the above required device. The present invention provides for a buffer cover that can be utilized on any convention buffer or floor machine. This buffer cover is multi-layered and is designed to conform to and securely fit around a conventional buffer.

The buffer cover has an outer shell having a circular configuration. The outer shell is made from a non-porous material. The outer shell has a top surface and a bottom surface. The top surface includes an opening. This opening receives the conventional buffer. When the buffer is received within the cover, elastic disposed within the circumference of the top surface, insures a snug fit of the cover around the buffer.

Internally located within the cover is an absorbent material. This material absorbs any chemical that may be on the buffer pad. This material is of a sufficient thickness so that the buffer can be rested upright when not in use without damage to the buffing pad.

When the buffer cover is used, the buffer can be moved across sensitive surfaces without fear of damage to the surface. If the buffer is to remain unused for an extended period of the time, the buffing pad need not be cleaned. The buffer cover will prevent the pad from drying out.

Therefore, is it an object of the present invention to provide for a buffer cover that will prevent floor or surface damage from chemical drips when relocating a buffer from one job location to the next job location.

It is another object of the present invention to provide for a buffer cover that will save on clean-up and labor time.

It is another object of the present invention to provide for a buffer cover that will alleviate the pressure placed on the bristles of the brush located on a buffer.

It is another object of the present invention to provide for a buffer cover that will be useful and beneficial for temporary storage of a buffer pad.

It is a final object of the present invention to provide for a buffer cover that is easy to use, inexpensive to fabricate, and durable in operation.

BRIEF DESCRIPTION OF THE DRAWINGS

FIG. 1 is an isometric view of the buffer cover according to the present invention attached to a conventional floor machine.

FIG. 2 is a top elevational view of the buffer cover according to the present invention.

FIG. 3 is a cross sectional view of the buffer cover according to the present invention taken along line 3—3 in FIG. 2.

Similar reference numerals refer to similar parts throughout the several views of the drawings.

DESCRIPTION OF THE PREFERRED EMBODIMENTS

FIGS. 1–3 show the various views of the buffer covering of the present invention. As seen, the buffer cover 10 is attached to a conventional floor buffing machine 12. The buffer cover 10 has an outer shell 28 which has a circular configuration. This outer shell includes a top surface 14, a bottom surface 16, and an encompassing side wall 18.

Located on the top surface of the outer shell is an opening 20. The conventional floor machine is received through this opening. Attached to the edge of the opening is an elastic band 22. This elastic band assists in providing a snug fit of the buffer cover to the floor buffing machine.

Optionally, two small openings 24 can be provided in the upper surface of the buffer cover. These two openings accommodate any wheels that may be attached to the floor buffing machine.

Internally located in the outer shell is an absorbent layer 26. This absorbent layer is attached to the bottom surface of the outer shell. The absorbent layer not only absorbs the chemicals from the pads and pad components (not illustrated) of the floor buffing machine, but also protects and relieves the pressure that is applied to the bristles of the brush (not illustrated) that may be attached to a floor buffing machine.

In order to utilize the buffer cover, the elastic band is pulled outward, causing the opening to increase in size. This increase in size will allow the buffing machine to be received into the buffer cover. Once the buffer cover is on the buffing machine, the elastic band is released, and the elastic band retracts to its original size. The cover is thereby secured on the buffing machine.

The outer shell can be fabricated from any durable material such as vinyl or leather. The absorbent material can be fabricated from any absorbent material such as foam.

The invention has been described with reference to a floor buffing machine. However, the invention can also be utilized on a hand-held buffer such as is used for furniture or vehicle use. Such a buffer cover would be identical in construction and operation to the above-described cover (the optional wheel openings would not be necessary).

While the invention has been particularly shown and described with reference to an embodiment thereof, it will be understood by those skilled in the art that various changes in form and detail may be made without departing from the spirit and scope of the invention.

I claim:

1. A buffer cover to be used in combination with a floor machine comprising:

an outer shell;

said outer shell is adapted to be removably secured to said floor machine quickly and efficiently after use of said floor machine;

said outer shell has a top surface, an encompassing side surface, and a bottom surface;

said bottom surface has an outside portion and an inside portion;

said outside portion faces a floor or work surface;

said top surface has an outside area and an inside area;

said inside area of said top surface faces said inside portion of said bottom surface;

an opening;

said opening is centrally located in said top surface;

said opening has an edge;

an elastic band;

said elastic band is attached to said edge of said opening;

an absorbent layer;

said absorbent layer is attached to said inside portion of said bottom surface; and said absorbent layer absorbs excess chemicals, solutions or like from said floor machine and said outer shell maintains said absorbent layer and said outer shell possesses properties for enabling said excess chemicals, said solutions or like to remain within said inside portion, for enabling said floor machine to be transported without leakage.

2. The buffer cover as in claim 1 wherein said absorbent layer is made of foam.

3. A buffer cover to be used in combination with a floor machine comprising:

an outer shell;

said outer shell has a top surface, an encompassing side surface, and a bottom surface;

said bottom surface has an outside portion and an inside portion;

said outside portion faces a floor or work surface;

said top surface has an outside area and an inside area;

said inside area of said top surface faces said inside portion of said bottom surface;

an opening;

said opening is centrally located in said top surface;

said opening has an edge;

an elastic band;

said elastic band is attached to said edge of said opening;

an absorbent layer;

said absorbent layer is attached to said inside portion of said bottom surface;

said top surface further includes a first holes and a second hole; and said first hole and said second hole are smaller than said opening.

4. The buffer cover as in claim 2 wherein said outer shell is made of vinyl.

5. The buffer cover as in claim 3 wherein said first hole and said second hole are identical in shape and size.

6. The buffer cover as in claim 3 wherein said outer shell is made of vinyl or leather.

7. The buffer cover as in claim 3 wherein said absorbent layer is made of foam.

* * * * *